US008306705B2

(12) United States Patent
Nichols et al.

(10) Patent No.: US 8,306,705 B2
(45) Date of Patent: Nov. 6, 2012

(54) EARTHMOVING MACHINE SENSOR

(75) Inventors: Mark Edward Nichols, Christchurch (NZ); Edward Wolf, Dayton, OH (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 973 days.

(21) Appl. No.: 12/101,502

(22) Filed: Apr. 11, 2008

(65) Prior Publication Data

US 2009/0259373 A1 Oct. 15, 2009

(51) Int. Cl.

| | |
|---|---|
| ***G06F 7/70*** | (2006.01) |
| ***G06F 19/00*** | (2006.01) |
| ***G06G 7/00*** | (2006.01) |
| ***G06G 7/76*** | (2006.01) |
| ***G08B 13/14*** | (2006.01) |

(52) U.S. Cl. ..... 701/50; 340/572.1; 340/686.6; 180/167; 710/12

(58) Field of Classification Search ..... 701/2, 50, 701/101–103, 114, 115; 700/2–5, 83–85, 700/108, 159, 275; 340/10.1, 572.1, 679, 340/686.6, 870.01; 235/375; 180/167; 710/12; 455/404.1

See application file for complete search history.

(56) References Cited

U.S. PATENT DOCUMENTS

| | | | | |
|---|---|---|---|---|
| 7,286,928 | B2 | 10/2007 | Spengler | |
| 7,330,117 | B2 | 2/2008 | Ferguson et al. | |
| 7,398,137 | B2 | 7/2008 | Ferguson et al. | |
| 2006/0044146 | A1 * | 3/2006 | Ferguson et al. | 340/679 |
| 2006/0136101 | A1 * | 6/2006 | Spengler | 701/2 |
| 2006/0154642 | A1 * | 7/2006 | Scannell, Jr. | 455/404.1 |

* cited by examiner

*Primary Examiner* — Christophe J. Novosad
(74) *Attorney, Agent, or Firm* — Haynes and Boone, LLP

(57) ABSTRACT

System and method for providing an excavation characteristic associated with an earthmoving machine. In one embodiment, a radio frequency identification (RFID) tag associated with an attachment mounted to an earthmoving machine may be identified. An optical benchmark signal may be detected, by an optical receiver. The position of the attachment relative to the earthmoving machine may be determined based, at least in part, on identification of the RFID tag. The position of the attachment may be provided to an operator of the earthmoving machine.

20 Claims, 5 Drawing Sheets

EARTHMOVING MACHINE SENSOR

FIELD OF THE INVENTION

The present invention relates in general to a sensor for an earthmoving machine and more particularly to a sensor providing an excavation characteristic based, at least in part, on an identified attachment to the earthmoving machine.

BACKGROUND

Conventional earthmoving operations can employ various types of earth moving machines for excavation and preparation of construction sites. Conventional earthmoving operations typically involve the use of a particular attachment dependent on a task performed by the earthmoving machine. A variety of attachments of differing sizes and dimensions may be employed by the earthmoving machines for both large and small scale operations. Such attachments may be easily interchanged.

In operation, a typical earth moving machine may work to move earth or material to a certain level or grade. Operation of the machine may be based on a particular attachment. However, operation of the earth moving machine may not be accurate if characteristics of an attachment are not addressed. As such, an operator of the earth moving machine may not have the benefit of assessing a digging depth or range when operating an earthmoving machine.

Thus there is an unsatisfied need for a system and method for addressing the characteristics of attachments to earthmoving machinery and/or improving operation of earthmoving machine indicators.

BRIEF SUMMARY OF THE INVENTION

Disclosed and claimed herein are a system and method for providing an excavation characteristic associated with an earthmoving machine. In one embodiment, a radio frequency identification (RFID) tag associated with an earthmoving machine attachment is identified and an optical benchmark signal generated by an optical receiver can be detected. The position of the attachment relative to the earthmoving machine can be determined based, at least in part, on identification of the RFID tag. The position of the attachment is provided to an operator of the earthmoving machine.

Other aspects, features, and techniques of the invention will be apparent to one skilled in the relevant art in view of the following detailed description of the invention.

DETAILED DESCRIPTION OF EXEMPLARY EMBODIMENTS

Figure 1:
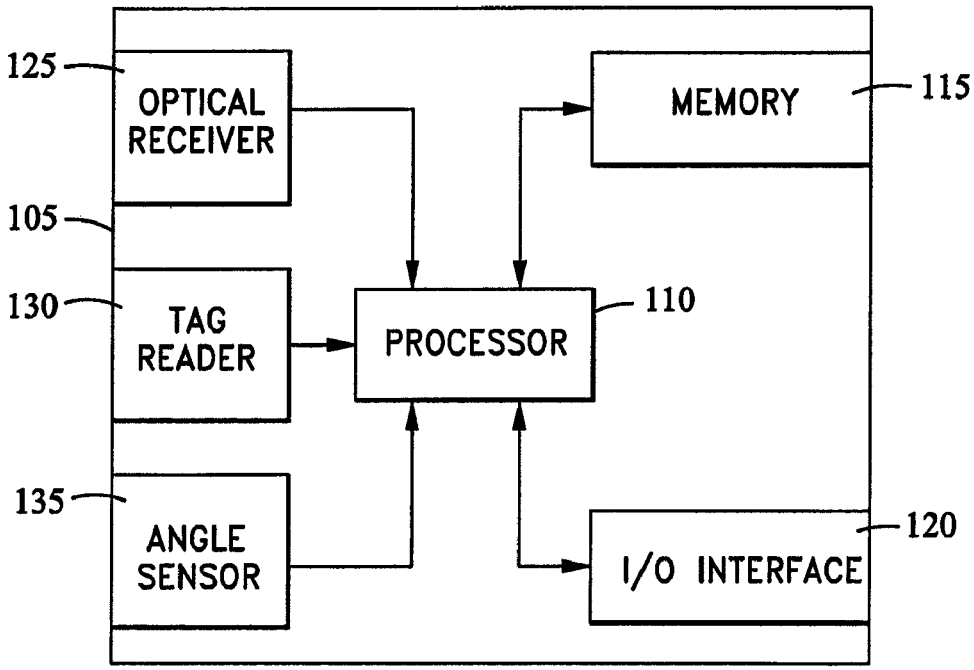
FIG. 1 depicts a simplified block diagram of a sensor according to one or more embodiments of the invention.

One aspect of the present invention is directed to sensing position and identification of an attachment to an earthmoving machine. In one embodiment, the invention relates to a sensor including a radio frequency identification (RFID) tag reader and an optical receiver. The RFID tag reader can be configured to identify an attachment to the excavation machine. According to another embodiment, the RFID tag reader may be configured to receive physical characteristics of the attachment according to another embodiment of the invention. The sensor may be configured to output one or more signals to a controller providing the position of the attachment to the earthmoving machine. In that fashion, positioning of the attachment and an excavation characteristic may be provided to an operator of the excavation machine for control of an attachment. According to another embodiment, the sensor may be configured to detect relevant objects and/or targets in the vicinity of the earthmoving machine.

Another aspect of the invention relates to a system having an optical source, a sensor and a controller. The sensor may be configured to receive an optical benchmark signal generated by the optical source and to output positioning information of the attachment to the controller. The sensor may be configured to identify an attachment of the earthmoving machine. According to another embodiment, the controller may be configured to display an excavation characteristic and/or data associated with one or more output signals from the sensor. For example, excavation characteristics such as digging depth, orientation of an attachment and depth to grade may be provided to an operator of the earth moving machine. According to another embodiment, the system may provide an operator with at least one of a two dimensional and three dimensional measurement based, at least in part, on one or more output signals of the sensor.

According to another aspect of the invention, a process may be provided for providing an excavation characteristic of an attachment to an earthmoving machine. In one embodiment, the process may include identifying an attachment to the earthmoving machine, receiving an optical benchmark signal and outputting one or more signals to a controller. Similarly, the process may include receiving an angular measurement related to orientation of an attachment to the earthmoving machine and outputting the one or more signals to the controller related to the angular measurement.

In yet another embodiment, a sensor may be provided wherein the sensor includes a RFID tag reader and an angle sensor. The angle sensor may be configured to output one or more signals to a controller such that an angular position of the attachment may be provided to an operator of the earthmoving machine. In one embodiment, angular position of the attachment may correspond to angular orientation of at least one of the attachments and an earthmoving machine member coupled to the attachment. The attachment to the excavation machine may be identified by the RFID tag reader. In that fashion, positioning of the attachment and an excavation characteristic may be provided to an operator of the excavation machine for control of the attachment.

When implemented in software, the elements of the invention are essentially the code segments to perform the necessary tasks. The program or code segments can be stored in a processor readable medium. The "processor readable medium" may include any medium that can store or transfer information. Examples of the processor readable medium include an electronic circuit, a semiconductor memory device, a ROM, a flash memory or other non-volatile memory, a floppy diskette, a CD-ROM, an optical disk, a hard disk, a fiber optic medium, etc. The code segments may be downloaded via computer networks such as the Internet, Intranet, etc.

Referring now to the drawings, FIG. 1 illustrates a sensor for an earthmoving machine according to one or more embodiments of the invention. As shown in FIG. 1, sensor 105 includes a processor 110 coupled to memory 115, input/output (I/O) interface 120, optical receiver 125 and RFID tag reader 130 and an optional angle sensor 135. Sensor 105 may be configured to provide an excavation characteristic for an excavation machine. As used herein an "excavation characteristic" corresponds to at least one of an digging depth, depth to grade, depth to final grade, slope and position of the earthmoving machine, and orientation of the attachment to the excavation machine. It may also be appreciated that sensor 105 may be configured to determined an excavation characteristic based on a particular excavation machine as will be described below in more detail with reference to FIGS. 2 and 3.

According to another embodiment, optical receiver 125 can detect an optical benchmark signal providing a reference elevation. It may be appreciated that optical receiver 125 can detect an optical signal such as a laser light beam, infrared beam or any optical beam in general. As such, when an optical benchmark signal impinges on optical receiver 125, the receiver 125 can output one or more signals to processor 110. Optical receiver 125 may include at least one photocell to receive an optical benchmark signal as will be described in more detail with respect to FIGS. 6A-6B. According to another embodiment, RFID tag reader 130 of sensor 105 can identify an RFID tag associated with an attachment to the excavation machine. Attachments to excavation machinery may be labeled with an RFID tag. In one embodiment, an RFID tag can provide identification, such as a reference number, of a particular type of attachment. It may also be appreciated that relevant objects may be labeled with an RFID tag. As such, sensor 105 may be configured to detect an object, utility equipment and/or a boundary, as will be described below in more detail with respect to FIG. 2.

According to another embodiment, RFID tag reader 130 may be configured for transferring data. For example, an RFID tag may provide data including dimensions of a particular attachment. The RFID tag reader 130 can output one or more signals to processor 110 for any identified RFID tags and/or associated data related to the attachment provided by the RFID tag. Similarly, RFID tag reader 130 can output one or more signals to processor 110 for data related to an RFID tag associated with identified objects in the vicinity of the excavation machine. According to another embodiment, RFID tag reader 130 may have an operating range of at least 10 meters. However, it should also be appreciated that RFID tag reader 130 may be operable in other ranges. Processor 110 can output one or more signals via I/O 120 in response to signals provided by optical receiver 125 and RFID tag reader 130. Similarly, processor 110 can store output of optical receiver 125 and RFID tag reader 130 to memory 115. Memory 115 may comprise at least one of ROM and RAM memory and may further contain executable instructions for processor 110. According to another embodiment, processor 110 can be any type of processor such as a microprocessor, field programmable gate array (FPGA) and/or application specific integrated circuit (ASIC).

Continuing to refer to FIG. 1, sensor 105 may include an optional angle sensor 135 coupled to processor 110. Angle sensor 135 may be configured to detect the angular position of an attachment to an excavation machine and provide one or more output signals to processor 110. For example, angle sensor 130 may be configured to determine the angle of orientation of one of the attachments and a member of the earthmoving machine. In one embodiment, angle sensor 130 may be a gravity referenced angle sensor. As such, output of the angle sensor 135, output of at least one of optical receiver 125 and output of the RFID tag reader 130 provide an excavation characteristic to an operator of an excavation machine. According to another embodiment, angle sensor 135 may be configured to sense the positioning of an attachment to an earthmoving machine as will be described in more detail below with respect to FIG. 3. It should be appreciated that processor 110 may be configured to output one or more signals for each of the optical receiver 125, RFID tag reader 130 and angle sensor 135 serially or in parallel.

Figure 2:
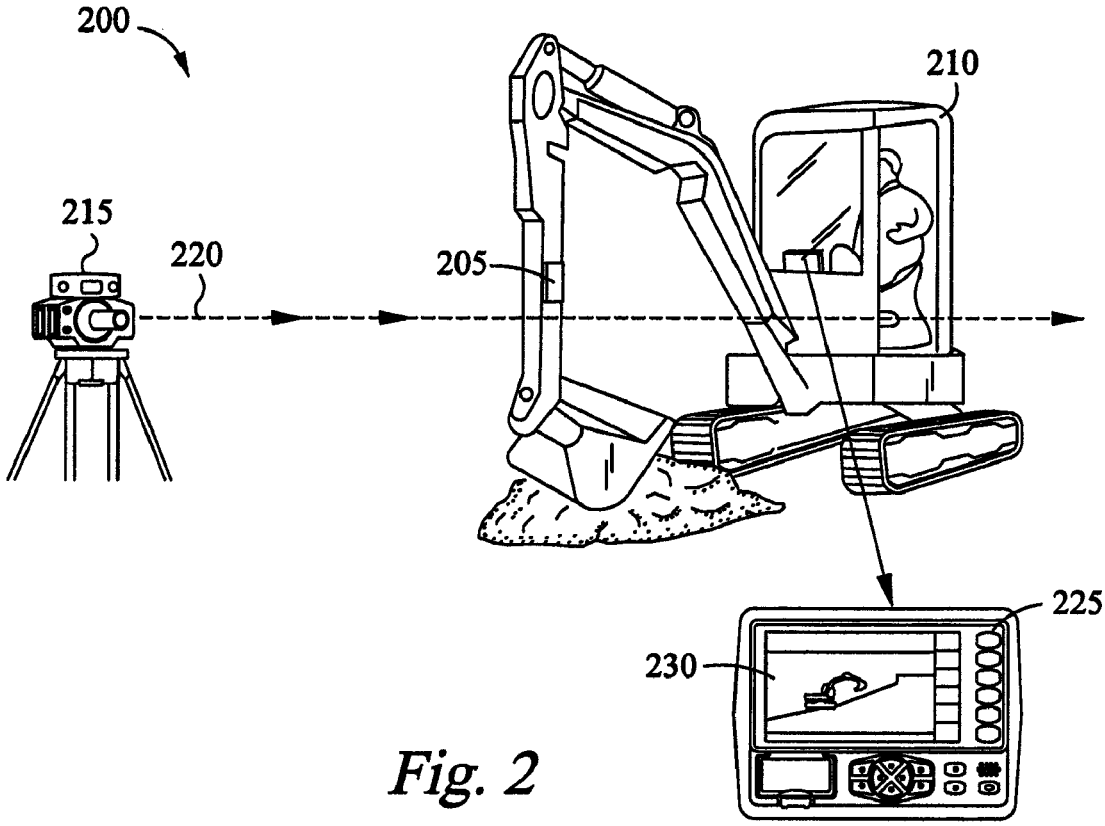
FIG. 2 depicts a simplified system diagram of a system according to one or more embodiments of the invention.

Referring now to FIG. 2, a simplified diagram is shown of a system 200 which may employ the sensor of FIG. 1 according to one or more aspects of the invention. As shown in FIG. 2, system 200 includes a sensor 205 (e.g., sensor 105), an optical source 215 and a controller 225. According to one embodiment of the invention, sensor 205 may be configured to detect an optical benchmark signal 220 generated by optical source 215. Optical source 215 may be configured to provide at least one of a laser and optical light beam in general. It may be appreciated that optical source 215 can provide a relative reference elevation for determination of an excavation characteristic of the earthmoving machine. While a single optical source 215 is shown in FIG. 2, it may be appreciated that a plurality of optical sources may be employed to interoperate with sensor 205 and controller 225 according to another embodiment of the invention. Sensor 205 may provide one or more signals to controller 225 by a wired or wireless link. According to one embodiment of the invention, sensor 205 may be configured to provide one or more signals to controller 225 while the excavation machine is stationary or in motion. As such, it may be appreciated that the position of an attachment to earthmoving machine 210 may be presented by controller 225 in real time.

According to another embodiment, sensor 205 may be configured to detect objects labeled with an RFID tag in the vicinity of earthmoving machine 210. For example, objects and/or materials including, but not limited to, trees, fill (e.g., gravel, stone, etc.), ore deposits, other vehicles, etc., may be labeled with RFID tags. As such, sensor 205 may be configured to detect and identify the objects or material. It should also be appreciated that sensor 205 may be configured to detect buried and/or obstructed utility equipment according to another embodiment of the invention. For example, sensor 205 may be configured to detect power lines, communication lines, plumbing, etc. Further, it may also be appreciated that sensor 205 may be configured to detect a boundary based, at least in part, on RFID tags associated with property lines, avoidance zones and boundary markers in general.

According to another embodiment, controller 225 may be mounted in a cab of an earthmoving machine to provide the position of an attachment to an operator of the earthmoving machine. Controller 225 may provide a display 230 for indicating a plurality of excavation characteristics including at least one of digging depth, depth to grade, depth to final grade, slope and position of the earthmoving machine as will be described in more detail with reference to FIG. 3. Further, controller 225 may be usable by an operator to enter desired excavation characteristics such that the relation between desired and measured characteristics may be provided to the operator. For example, a user can enter a target digging depth into controller 225. As such, controller 225 may be configured to display at least one of the target depth and the distance to the target depth. In another embodiment, controller 225 may be configured to alert an operator of the earthmoving machine when digging below a target grade.

According to another embodiment, controller 225 may be configured to alert an operator of the earthmoving machine of a detected object, utility equipment or a boundary. Such alerts may be visual and/or audible. It may also be appreciated that controller 225 may be configured to selectively disregard at least one detected object, utility and boundary. It may be appreciated that, recognition, and/or dismissal, of a detected RFID tag may be advantageous when an earthmoving machine is operating in the presence of a plurality of RFID tags. Controller 225 may be configured to recognize and/or disregard a detected RFID tag based on an identifier stored in memory (e.g., memory 115).

As shown in FIG. 2, earthmoving machine 210 is depicted as an excavator including a bucket attachment. However, it may be appreciated that sensor 205 may be employed by various types of earthmoving machines including, but not limited to a dozer, backhoe, excavator, scraper, skid steer, and leveler. Additionally, controller 225 may provide excavation characteristics for a plurality of attachments.

Figure 3:
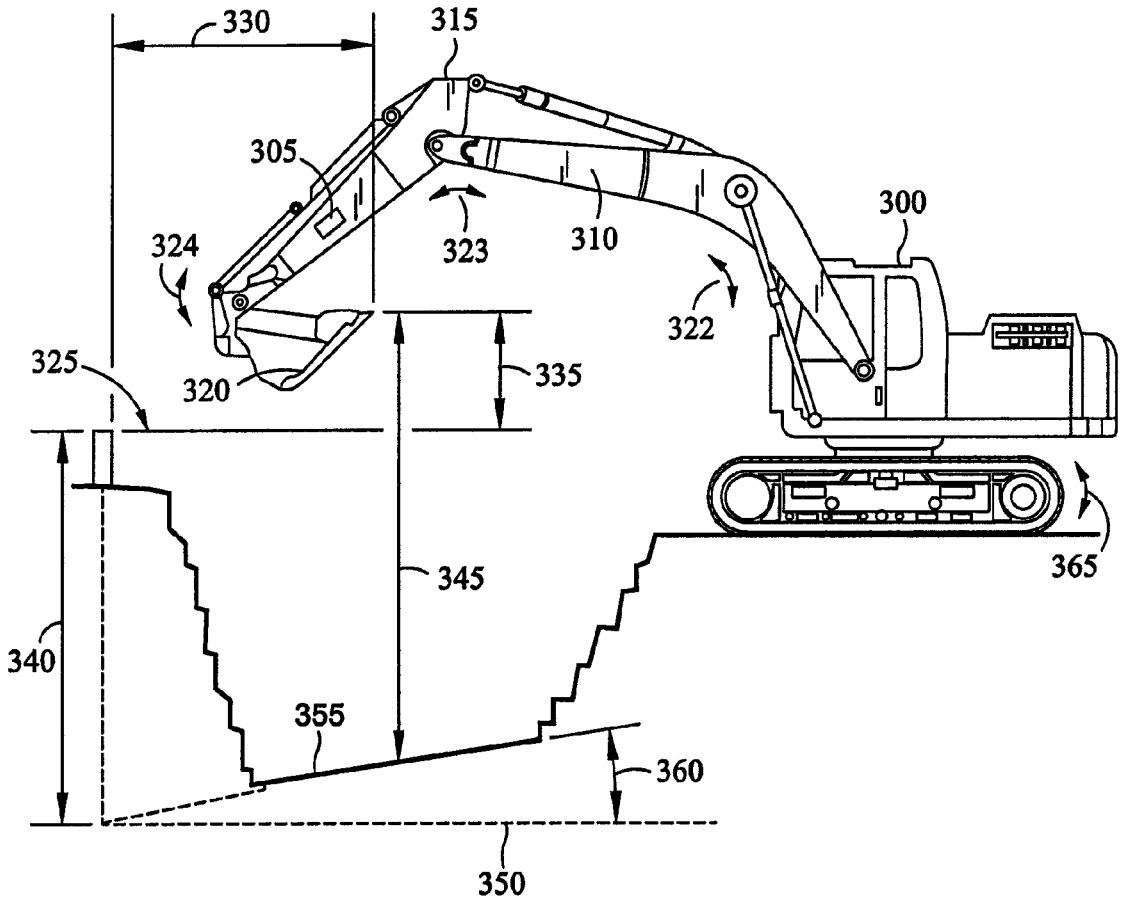
FIG. 3 depicts a graphical representation of an attachment to an earthmoving machine according to one or more embodiments of the invention.

Referring now to FIG. 3, earth moving machine 300 is shown which can employ the sensor of FIG. 1 according to one or more aspects of the invention. As shown in FIG. 3, a sensor 305 (e.g., sensor 105) is mounted to earthmoving machine 300, wherein earthmoving machine 300 is depicted as an excavator. According to one embodiment, sensor 305 may be coupled to earthmoving machine 300 in a known location for determining excavation characteristics of the earthmoving machine. As shown in FIG. 3, sensor 305 may be coupled to a lateral face of stick 315. However, it may be appreciated that sensor 305 may be mounted to various points of an earthmoving machine and/or may be mounted to a support member coupled to the earthmoving machine.

Characteristics of earthmoving machine 300 may be used by a controller (e.g., controller 225) to determine excavation characteristics based, at least in part, on one or more output signals by sensor 305. For example, earthmoving machine 300 includes an articulated arm comprising boom 310 and stick 315. Further, earthmoving machine 300 can include attachment 320 coupled to stick 315. As shown in FIG. 3, attachment 320 is shown as a bucket. However, it may be appreciated that various types of attachments may be coupled to stick 315 including, but not limited to thumbs, stump splitters, grapples, compaction wheels or excavating attachment in general. It may be further appreciated that an attachment 320 to earthmoving machine 300 may be characterized as having different dimensions. Thus, in accordance with one embodiment of the invention, sensor 305 (e.g., sensor 105) may sense an identification, such as a RFID tag, of an attachment to the earthmoving machine 305. According to another embodiment, sensor 305 may determine the position of attachment 320 to earthmoving machine 305 by using at least one angle sensor (e.g., angle sensor 135). Similarly, sensor 305 may be configured to determine at least one of angle 322 relative to body pitch 365 and optical benchmark 325, angle 323 relative to boom 310 and stick 315, and angle 324 relative to stick 315 and attachment 320.

Continuing to refer to FIG. 3, a controller (e.g., controller 225) may be configured to receive output of sensor 305 to determine an excavation characteristic for earthmoving machine 300. In one embodiment, the controller can determine at least one of: horizontal distance 330 from sensor 305 (e.g., sensor 105) to optical benchmark 325; vertical distance 335 from sensor (e.g., sensor 105) to optical benchmark 325; depth 340 from optical benchmark 325 to target depth 350, vertical distance 345 from attachment 320 to grade 355; and angle 360 of grade 355 relative to target depth 350. The controller may provide at least one of distances 330, 335, 340 and 345 based in part on one or more output signals from sensor 305. Further, excavation characteristics determined by the controller may incorporate characteristics of an attachment to the earthmoving machine based, at least in part, on output of sensor 305. According to another embodiment of the invention, the controller may be configured to compensate for body pitch 365 of the earthmoving machine.

Figure 4:
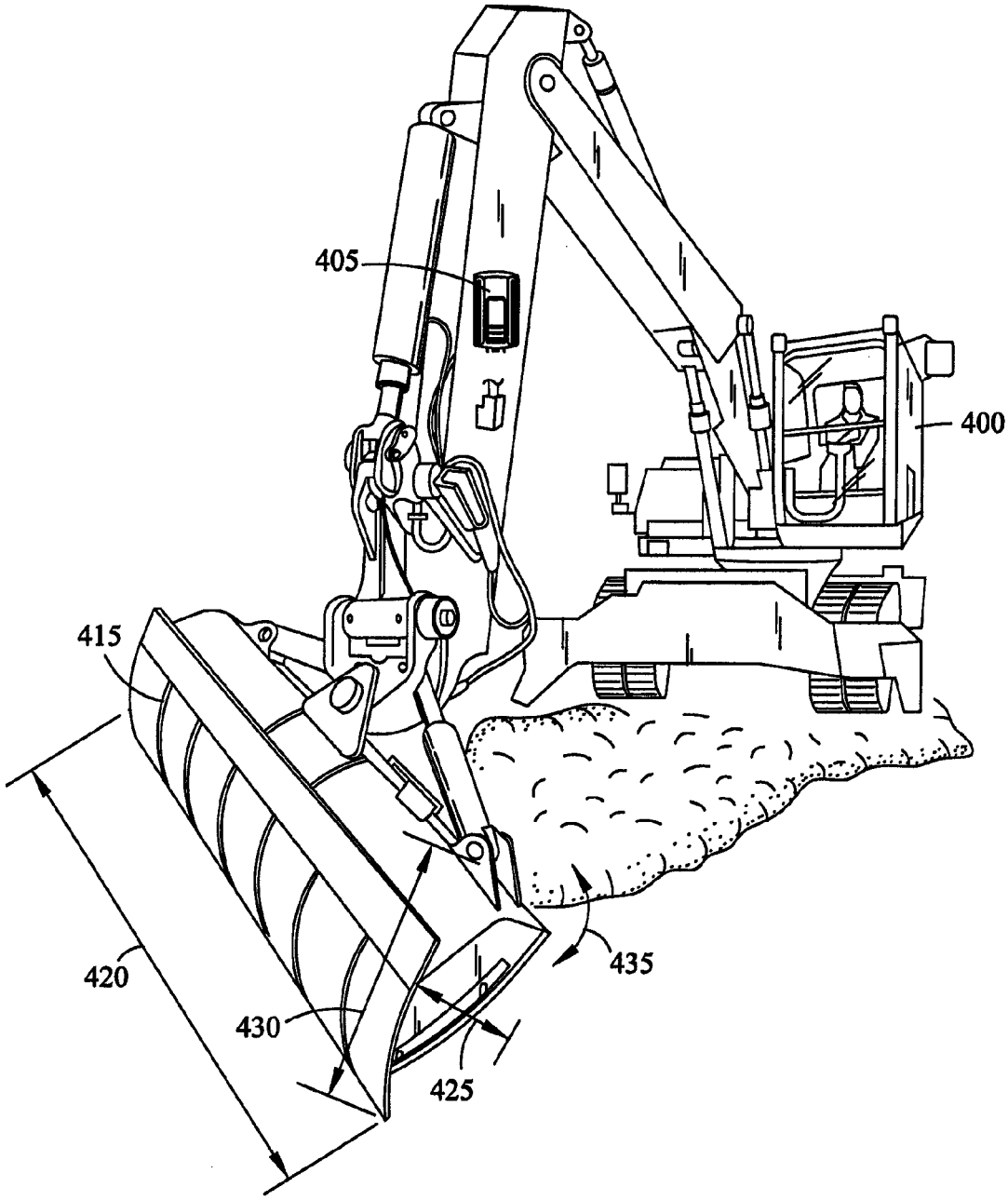
FIG. 4 depicts a graphical representation of an attachment to an earthmoving machine according to one or more embodiments of the invention.

Referring now to FIG. 4, earthmoving machine 400 is shown which can employ the sensor of FIG. 1 according to one or more aspects of the invention. As shown in FIG. 4, earthmoving machine 400 is illustrated as an excavator including sensor 405 (e.g., sensor 105). However, it may be appreciated that sensor 405 may be employed by various types of earthmoving machines including, but not limited to a dozer, backhoe, excavator, scraper, skid steer, and leveler. Characteristics of earthmoving machine 400 may be provided to a controller (e.g., controller 225) to determine excavation characteristics based, at least in part, on one or more output signals by sensor 405. As shown in FIG. 4, earthmoving machine 400 includes attachment 415. In one embodiment, attachment 415 may include an RFID tag coupled to the attachment. Sensor 405 may be configured to identify attachment 415 based on an RFID tag (not shown) coupled with attachment 415. In one embodiment of the invention, an RFID tag associated with attachment 415 may indicate the dimensions of the attachment including width 420, height 430 and depth 425. Similarly, it may be appreciated that sensor 405 may be configured to sense the angular position of attachment 415 as indicated by direction 435. Further, sensor 405 may be configured to receive an optical benchmark signal (e.g., optical benchmark signal 220). In that fashion, sensor 405 may provide one or more signals providing at least one of identification, angular position and vertical position of attachment 415 to a controller of earth moving machine 400. Based, at least in part, on the output of sensor 405 excavation characteristics accounting for characteristics of a particular attachment 415 may be provided operator of earthmoving machine 400. This can be particularly useful to provide excavation characteristics accounting for a plurality of attachment types.

Figure 5B:
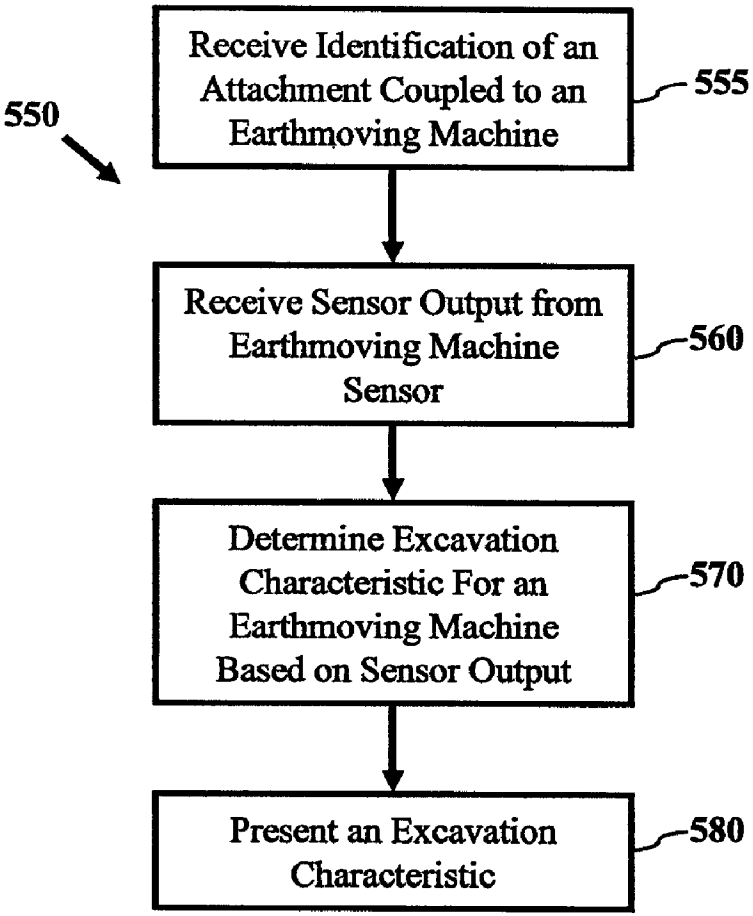
FIG. 5B depicts a process for a process for operation according to one or more embodiments of the system of FIG. 2.
Figure 5A:
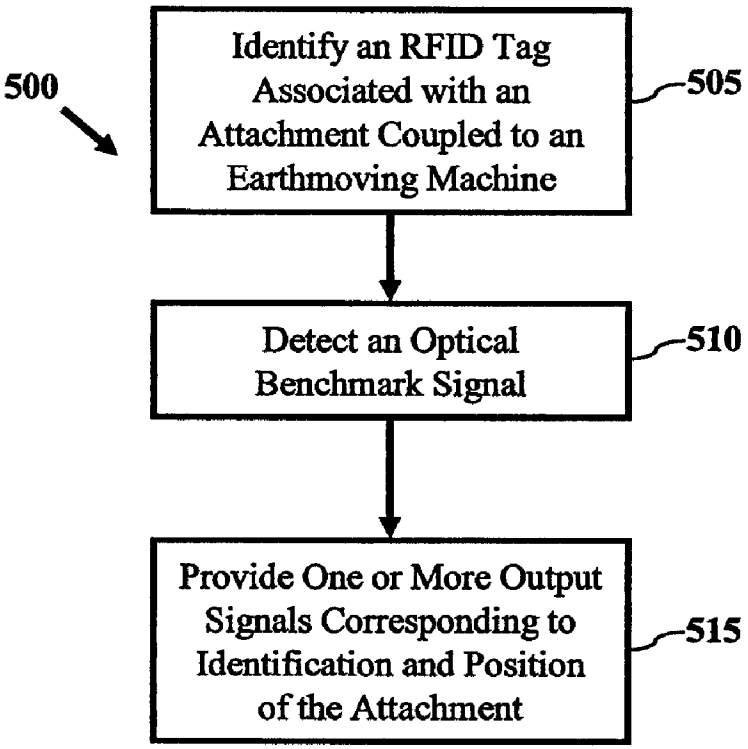
FIG. 5A depict a process for operation according to one or more embodiments of the sensor of FIG. 1.

Referring now to FIGS. 5A-5B, processes are shown which may employ the sensor of FIG. 1 according to one or more embodiments of the invention. As shown in FIG. 5A, process 500 may be utilized for determining an excavation characteristic of an earthmoving machine. It may be appreciated that process 500 may be performed by an earthmoving machine sensor (e.g., earthmoving machine sensor 105). Process 500 may be initiated at block 505 with identification of an RFID tag corresponding to an attachment coupled to an earthmoving machine. In one embodiment, an RFID tag associated with an attachment to an earthmoving machine may be identified by a sensor (e.g., sensor 105) mounted to the earthmoving machine. Process 500 may include receiving an optical benchmark signal as shown in block 510. At block 515 one of more signals may be output corresponding to identification of an attachment and a received bench mark signal. The one or more output signals may be transmitted to a controller for the earthmoving machine by either a wired or wireless connection.

Referring now to FIG. 5B, process 550 is shown according to one or more embodiments of the invention. It may be appreciated that process 550 may be performed by controller (e.g., controller 225) for an earthmoving machine. Process 550 may be initiated with receiving an identification of an attachment coupled to an earth moving machine as shown in block 555. In one embodiment, a controller (e.g., controller 225) can calibrate features of a display (e.g., display 230) based, at least in part, on identification of an attachment. As shown in block 560, one or more signals may be received from a sensor (e.g., sensor 105) by a controller (e.g., controller 225) related to an earthmoving machine. For example, the sensor may output signals related to at least one of detection of an optical benchmark signal, identification of an RFID tag and detection of an angular measurement. In block 570, an excavation characteristic may be determined for the earthmoving machine based on one or more signals received by a sensor in block 570. Process 550 may follow with displaying an excavation characteristic to an operator of the earth moving machine in block 580 (e.g., using display 230). It may also be appreciated that process 550 may include providing a visual and/or audible alert based, at least in part, on detection of an object, utility equipment and boundary in block 580.

Figure 6A:
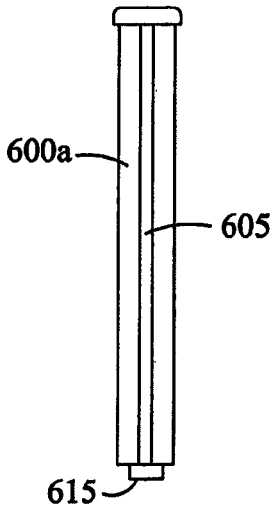
FIGS. 6A-B depict a sensor according to one or more embodiments of the sensor of FIG. 1.
Figure 6B:
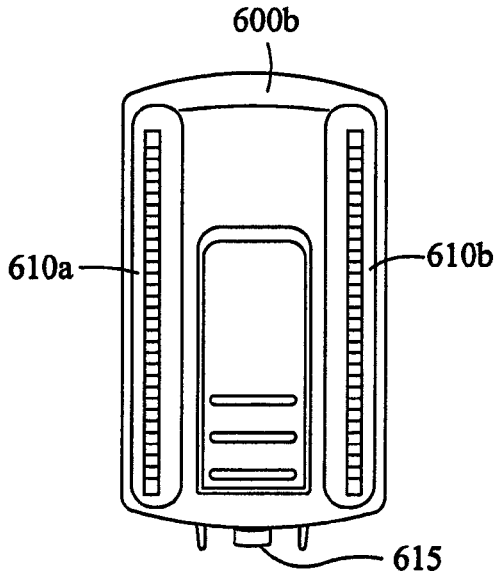

Referring now to FIGS. 6A-6B, sensor packages are illustrated which may be employed for the sensor of FIG. 1 according to one or more embodiments of the invention. Referring first to FIG. 6A, sensor package 600*a* is shown having a single optical receiver 605. Optical receiver 605 may be one of a photocell, laser catcher or optical receiver in general. Further, sensor package 600*a* may include an input/output interface 615 (e.g., input/output interface 120). Input/output interface may be one of a wired or wireless connection for communication with a controller (e.g., controller 225).

Referring now to FIG. 6B, a sensor package 600*b* is shown having a plurality of optical receivers 610*a*-610*b* according to another embodiment of the invention. It may be appreciated that optical receivers 610*a*-610*b* are one of a photocell, laser catcher or optical receiver in general. According to another embodiment of the invention, optical receivers 610*a* and 610*b* may be usable to sense an angle (e.g., angles 324, 323 and/or 322) of an attachment to an earthmoving machine and/or a member of the earthmoving machine. For example, an optical benchmark signal may be used as an angular reference plane impinging on optical receivers 610*a*-610*b*. According to another embodiment, sensor 600*b* may be mounted to an articulated arm of an excavator, wherein optical receivers 610*a*-610*b* may be configured to detect incident of an optical benchmark signal (e.g., optical benchmark signal 220). Further, sensor 600*b* may include an input/output interface 615 (e.g., input/output interface 120). As shown in FIGS. 6A-6B, optical receivers 605 and 610*a*-610*b* are shown as generally longitudinal in shape it may be appreciated that additional shapes may be provided for optical receivers 605 and 610*a*-610*b*.

Figure 7:
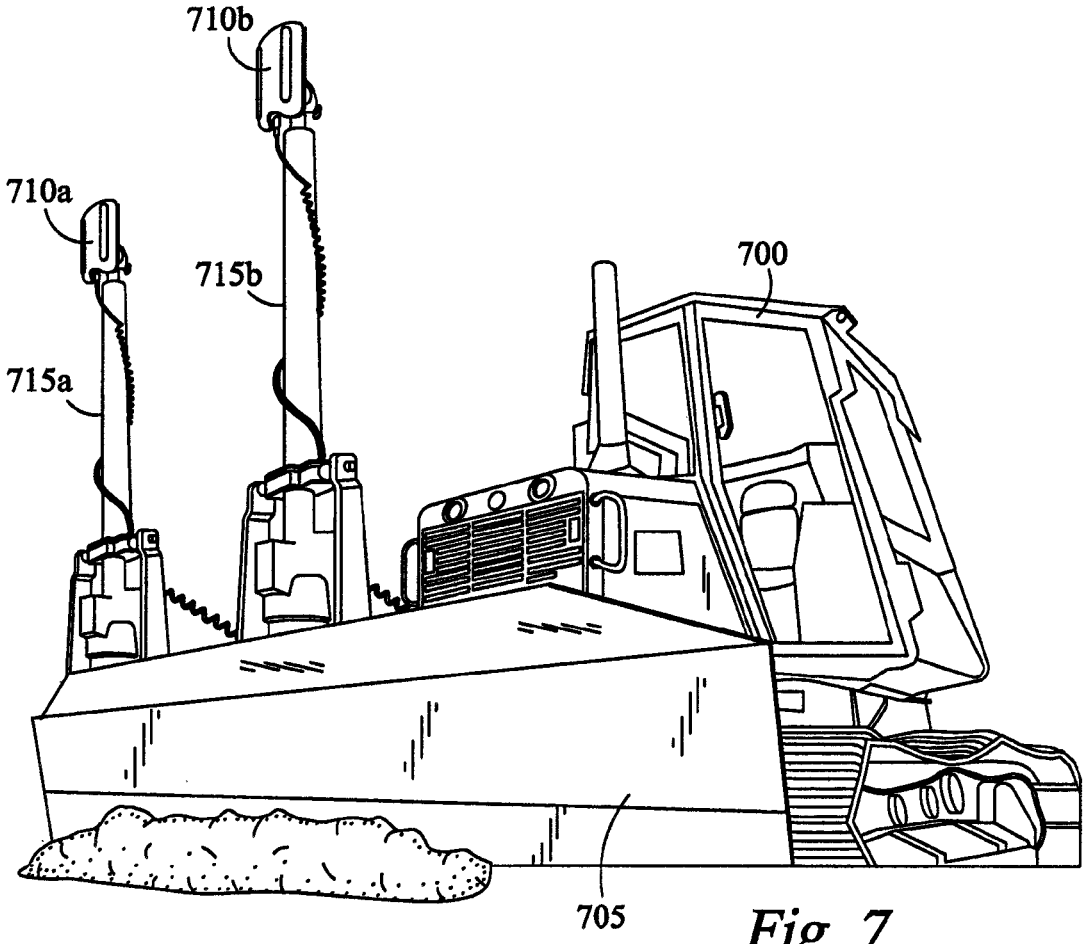
FIG. 7 depicts a graphical representation of a sensor attached to an earthmoving machine according to one or more embodiments of the invention.

Referring now to FIG. 7, an earthmoving machine 700 is shown which can employ the sensor 105 of FIG. 1. According to one embodiment of the invention, a plurality of sensors 710*a* and 710*b* (e.g., sensor 105) may be coupled to earthmoving machine 700. As shown in FIG. 7, sensors 710*a* and 710*b* may be coupled to masts 715*a* and 715*b* respectively, arranging the sensors in a position to receive an optical benchmark signal (e.g., optical benchmark signal 220). Further, masts 715*a* and 715*b* may be coupled to earthmoving machine to provide relative distance of an attachment 705 to the earthmoving machine. Sensors 710*a* and 710*b* may be configured to identify attachment 705. In that fashion, at least one of an angle and grade level associated with attachment 705 may be provided to an operator of earthmoving machine 700. It may further be appreciated that masts 715*a* and 715*b* may be telescoping masts configured to raise or lower sensors 710*a* and 710*b*. In yet another embodiment of the invention, sensors 710*a* and 710*b* may be configured to rotate to a fixed position to facilitate sensing of an optical benchmark signal.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. Trademarks and copyrights referred to herein are the property of their respective owners.

What is claimed is:

1. A sensor for an earthmoving machine, the sensor comprising:

a radio frequency identification (RFID) tag reader that identifies a RFID tag on an attachment coupled to the earthmoving machine;

an optical receiver that detects an optical benchmark signal; and an output circuit that provides one or more signals corresponding to identification of the RFID tag and position of the attachment.

2. The sensor of claim 1, wherein the RFID tag reader detects an RFID tag on at least one of an object, utility equipment, and a boundary located in the vicinity of the earthmoving machine.

3. The sensor of claim 1, wherein the optical receiver detects an angle of the earthmoving machine relative to the optical benchmark signal.

4. The sensor of claim 1, wherein the optical receiver detects a vertical distance of at least one of the earthmoving machine and the attachment relative to the optical benchmark signal.

5. The sensor of claim 1, further comprising a housing arranging the RFID tag reader and the optical receiver, the housing mounted to the earthmoving machine.

6. The sensor of claim 5, wherein the housing is mounted to a support mast of the earthmoving machine.

7. The sensor of claim 1, further comprising an angle sensor that detects the orientation of the attachment relative to the earthmoving machine.

8. A method comprising the acts of:

identifying a radio frequency identification (RFID) tag on an attachment coupled to an earthmoving machine;

detecting an optical benchmark signal, by an optical receiver, receiving optical signal data;

determining position of the attachment relative to the earthmoving machine based, at least in part, on identification of the RFID tag; and providing the position of the attachment to an operator of the earthmoving machine.

9. The method of claim 8, further comprising detecting an RFID tag on at least one of an object, utility equipment, and a boundary located in the vicinity of the earthmoving machine.

10. The method of claim 8, further comprising detecting an angle of the earthmoving machine relative to the optical benchmark signal.

11. The method of claim 8, further comprising detecting a vertical distance of at least one of the earthmoving machine and the attachment relative to the optical benchmark signal.

12. The method of claim 8, further comprising detecting the orientation of the attachment relative to the earthmoving machine.

13. A system comprising:

an optical source providing an optical benchmark signal;

a radio frequency identification (RFID) tag coupled to an attachment to an earthmoving machine;

a sensor that detects the RFID tag, receives the optical benchmark signal, and outputs one or more signals; and a controller coupled to the sensor, wherein the controller:

receives an identification of the tag on the attachment, determines a position of the attachment relative to the earthmoving machine based, at least in part, on the identification of the tag on the attachment, and provides the position of the attachment to an operator of the earthmoving machine.

14. The system of claim 13, wherein the sensor detects an RFID tag on at least one of an object, utility equipment, and a boundary located in the vicinity of the earthmoving machine.

15. The system of claim 13, wherein the optical benchmark signal comprises a planar laser beam signal.

16. The system of claim 13, wherein the sensor detects an angle of the earthmoving machine relative to the optical benchmark signal.

17. The system of claim 13, wherein the sensor detects a vertical distance of the earthmoving machine relative to the optical benchmark signal.

18. The system of claim 13, further comprising a housing arranging the RFID tag reader and the optical receiver to the earthmoving machine.

19. The system of claim 18, wherein the housing is mounted to a support mast of the earthmoving machine.

20. The system of claim 13, wherein the sensor further comprises an angle sensor that senses the orientation of the attachment relative to the earthmoving machine.

* * * * *